United States Patent [19]

Reimert

[11] Patent Number: 4,468,055

[45] Date of Patent: Aug. 28, 1984

[54] WELLHEAD APPARATUS

[75] Inventor: Larry E. Reimert, Houston, Tex.

[73] Assignee: Dril Quip, Inc., Houston, Tex.

[21] Appl. No.: 373,691

[22] Filed: May 3, 1982

[51] Int. Cl.[3] ..... F16L 21/00; F16L 55/00; F16L 21/06

[52] U.S. Cl. ..... 285/141; 285/18; 285/321

[58] Field of Search ..... 285/141, 140, 142, 143, 285/321, 18

[56] References Cited

U.S. PATENT DOCUMENTS

| | | | |
|---|---|---|---|
| 3,918,747 | 11/1975 | Putch | 285/141 X |
| 4,332,889 | 11/1980 | Putch | 285/143 X |
| 4,373,752 | 2/1983 | Nelson | 285/141 |

*Primary Examiner*—Richard J. Scanlan, Jr.
*Attorney, Agent, or Firm*—Vaden, Eickenroht, Thompson, Bednar & Jamison

[57] ABSTRACT

There are disclosed two embodiments of wellhead apparatus for use in suspending concentric strings of casing of an offshore well at the ocean floor. For this purpose, an inner hanger to which the inner casing is connected is adapted to be landed within an outer hanger to which the outer casing is connected, each at the ocean floor or "mudline". Seating surfaces are formed on the bore of the tubular body of the outer hanger body, and landing surfaces are formed on a circumferentially split landing ring arranged about the tubular body of the inner hanger and having landing surfaces formed thereabout for expansion and contraction within a recess about the tubular hanger body between a contracted position as it is moved vertically within the outer casing and bore of the tubular body of the outer hanger, and an expanded position in which the landing surfaces thereon are landed upon the seating surfaces when disposed opposite thereto. The landing ring is retained in a position for expansion and contraction within the recess by detent means which is releasable, when the landing ring is in landed position, and the weight of the inner casing is slacked off so as to lower the inner hanger body into supported position on the landing ring.

8 Claims, 8 Drawing Figures

WELLHEAD APPARATUS

This invention relates generally to wellhead apparatus; and, more particularly, to improvements in wellhead apparatus for use in suspending concentric strings of casing of an offshore well at the ocean floor.

In apparatus of this type, commonly referred to as a "mudline" suspension system, each of a plurality of inner casing strings is lowered into a bore drilled in the ocean floor by means of a hanger to which an upward extension of the casing string is connected. When the hanger is landed within a hanger from which the next outer casing string is suspended, cement is circulated down through the extension, hanger, and suspended string, and up into the annulus about the suspended string to anchor it in place. When the well has been tested, the casing extensions may be retrieved, and the hangers at the upper ends of the casing strings capped or closed off at the ocean floor, to permit the drilling rig to be moved to another location. When it is desired to complete the well for production purposes, the cap is removed and casing extensions are lowered into connection with at least the innermost suspended casing strings to tie them back to a production platform at the surface of the water.

The annular spaces between an outermost conductor casing and the next inner casing string, and between certain of the successively inner casings, are ordinarily sufficiently large that each string may be suspended from the next outer string by means of a hanger having an outer shoulder adapted to land on a seat on the bore of the hanger from which the next outer casing string is suspended. The shoulder has a bypass therethrough to connect the annular space above and below it for circulation of cement returns, and a running tool connects each hanger to the casing extension.

However, since the annular spaces between the innermost casing strings are much smaller, it has been proposed (See U.S. Pat. No. 3,420,308, for example) to suspend them by means of hangers carrying circumferentiallly split landing rings which are contractible to permit the hanger to be lowered with the string into a position of the next outer hanger, and then expandible to move a landing surface thereabout into landed position on the seat. More particularly, the landing ring is of such construction that it tends to assume its expanded position, but yields in response to a radially inwardly directed force so as to move to its contracted position.

As also shown in the aforementioned patent, a ring is connected to the inner hanger body by means of a shear pin so as to dispose an annular shoulder thereon in position to engage a shoulder on the landing ring, and thereby retain the landing ring against upward movement with respect to the inner hanger body as the landing ring expands and contracts within the recess. However, when the landing ring has landed on the outer hanger body, and the weight of the inner casing string is slacked off, the pin shears to permit the inner hanger body to move downwardly with respect to the landing ring until a shoulder on its upper end engages an upwardly facing shoulder on the upper end of the landing ring to support the inner hanger body from the landing ring and then from the outer hanger and casing string. At the same time, an outer circumferential surface about the inner hanger body moves within an inner circumferential surface on the inner hanger body so as to hold the landing ring against movement radially inwardly and out of landed position.

Due to the small annular space between the casing strings, and thus between the inner and outer casing hanger bodies, the outer sides of the inner hanger bodies as well as the landing rings are provided with slots to permit well fluids to circulate therethrough between annular spaces between casing strings above and below the hangers. In the case of the wellhead apparatus of the above-mentioned patent, these include slots formed in the outer side of the inner hanger body so as to bypass the shear ring on which the inner hanger body is supported.

In apparatus of the type described, the shear pins may be accidentally sheared, if the landing ring engages an obstruction in the bore of the hanger body other than the seat therein. If this occurs, and the hanger is landed prematurely, it is impossible to reposition the landing ring without raising the equipment to the surface level for replacement of the shear pins. Also, since the inner hanger body is supported on the landing ring by means of a shoulder in which bypass slots are formed, the capacity of such apparatus to carry the load of the inner casing is severely limited.

An object of the present invention is to provide wellhead apparatus of this type wherein the landing ring of the hanger may be reset or returned to a position in which it is retained for expansion and contraction within the recess about the inner hanger body, without raising the hanger to the surface level; and, more particularly, in which the landing ring may be reset automatically in response to upward movement of the inner hanger body with respect to the landing ring for not more than a few inches.

Another object of the invention is to provide wellhead apparatus of the type above described in which the inner hanger body is supported from the landing ring in such a way as to permit greater loads to be carried thereby; and, more particularly, by means of apparatus which makes possible the necessary fluid bypass, but nevertheless transmits the load of the inner casing through shoulders which provide substantially full circle support therefor.

These and other objects are accomplished, in accordance with the illustrated embodiment of the invention, by means of apparatus of the type described wherein the landing ring is retained against upward movement with respect to the inner hanger body, as the landing ring expands and contracts within the recess, by detent means which is releasable to permit the inner hanger body to be lowered into supported position on the landing ring, while such landing ring is landed on the outer hanger body, and the weight of the inner casing is slacked off. More particularly, upon raising of the inner hanger body only a matter of inches with respect to the landing ring, the detent means is returned to a position in which it again retains the landing ring against upward movement with respect to the inner hanger body as the landing ring expands and contracts within the recess. Thus, in the event it is inadvertently released to permit premature landing of the landing ring, the detent means may be reset as many times as necessary without having to raise such hanger to the water surface.

The detent means comprises circumferentially yieldable means having annular shoulder means carried by one of the landing ring and inner hanger body for engagement with annular shoulder means on the other of the landing ring and inner hanger body. Preferably, the circumferentially yieldable means is carried by the inner hanger body so as to release the inner hanger body for movement downwardly with respect to the landing ring without having to expand or contract the landing ring. In the preferred and illustrated embodiment of the invention, the yieldable means comprises a circumferentially split ring which is carried by the inner hanger body and which has an annular shoulder thereon engageable with an annular shoulder on the landing ring, so as to retain the landing ring against upward movement, but disengageable therefrom when the landing ring is landed on the outer hanger body and the inner hanger body is lowered with respect thereto, as above described. In one embodiment of the invention, the detent ring tends to assume its expanded position and is disposed within the landing ring so that the detent shoulder thereof engages a detent shoulder within the landing ring. In another embodiment of the invention, the detent ring tends to assume its contracted position and is disposed about the landing ring so that the detent shoulder thereof engages a detent shoulder about the landing ring.

In both embodiments, the landing ring is more resistant to expansion or contraction, when contracted, than is the detent ring so that the detent shoulder of the detent ring moves out of engagement with the detent shoulder of the landing ring. Thus, in the first mentioned embodiment, the detent ring contracts to move its detent shoulder out of engagement with the detent shoulder of the landing ring, and, in the second mentioned embodiment of the invention, the detent ring expands to move its detent shoulder out of engagement with the detent shoulder of the landing ring. In both cases, therefore, the landing ring need not be moved circumferentially inwardly from its fully landed position on the outer tubing hanger, thereby preventing inadvertent movement of the landing ring out of landed position.

As in the case of the above-described prior apparatus of this type, the inner hanger body is adapted to be supported on the landing ring in order to support the inner casing therefrom, and has an outer circumferential surface which is adapted to move within an inner circumferential surface on the landing ring in order to hold the landing ring in landed position, when the inner hanger body is so supported. In accordance with another novel aspect of the present invention, however, the outer circumferential surface of the inner hanger body is formed on a radially enlarged portion thereof at the upper end of the recess, and a groove is formed about the inner hanger body above the radially enlarged portion to receive a load ring which has a radially inner portion of its lower end supported on the lower end of the groove, a substantiallly circumferentially continuous shoulder at its upper end facing a substantially circumferentially continuous shoulder on the upper end of the groove for abutment therewith, and a substantially circumferentially continuous shoulder on the radially outer portion of its lower end which is adapted to be supported on a substantially circumferentially continuous shoulder on the landing ring, when the landing ring is in landed position and the inner hanger body has been lowered to dispose its circumferential surface within the inner circumferential surface of the landing ring. More particularly, the radially enlarged portion of the inner hanger body and the radially inner portion of the load ring have connecting slots therein, and the load ring also has ports which connect the upper ends of the slots therein with the outer side of the load ring, whereby well fluid may circulate through the slots and ports so as to connect the annular space between the inner hanger body and bore of the outer hanger body above and below the landing and load rings. At the same time, the load of the inner hanger body on the load ring and of the load ring on the landing ring is transmitted through substantially circumferentially continuous shoulders so as to provide maximum load carrying capacity.

Preferably, the substantially circumferentially continuous shoulders of the load ring are of substantially the same area. Also, the lower end of the radially enlarged portion of the inner hanger body and the shoulder of the landing ring on which the load ring is to be supported are tapered, so as to urge the landing ring outwardly to fully landed position as the inner hanger body is lowered with respect thereto. For assembly purposes, and in order to reduce machining requirements to a minimum, the load ring is formed of arcuate segments, whose opposite ends are close together so as to provide almost a full 360 degrees of loading surface about the shoulders on its upper and lower ends.

In the drawings, wherein like reference characters are used throughout to designate like parts:

Figure 1:
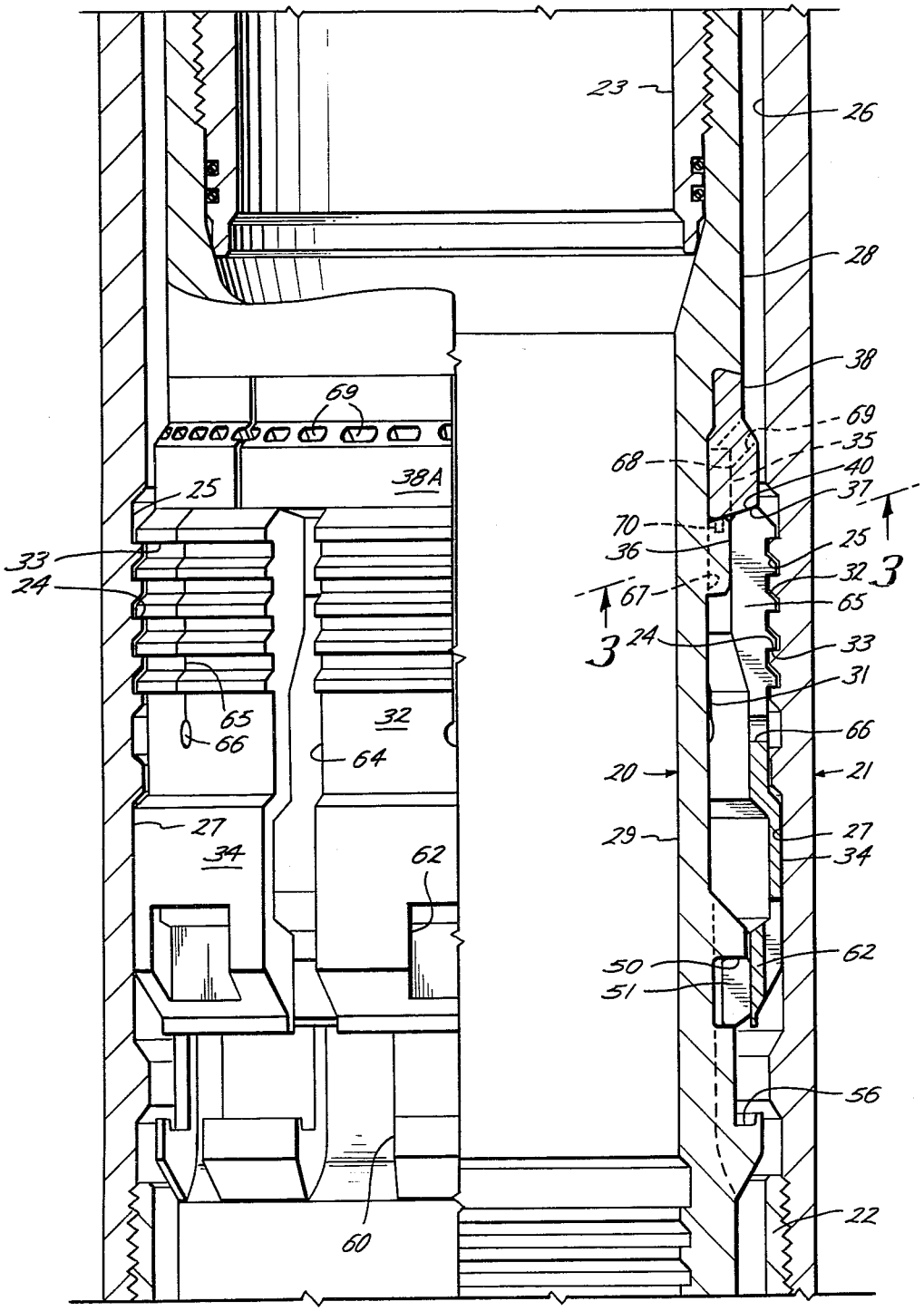
FIG. 1 is a vertical sectional view of an inner hanger body landed within an outer hanger body of wellhead apparatus constructed in accordance with the one embodiment of the present invention, the inner hanger body, landing ring and load ring thereof being shown in elevation on the left-hand side of the figure and in section on the right-hand side thereof.
Figure 4:
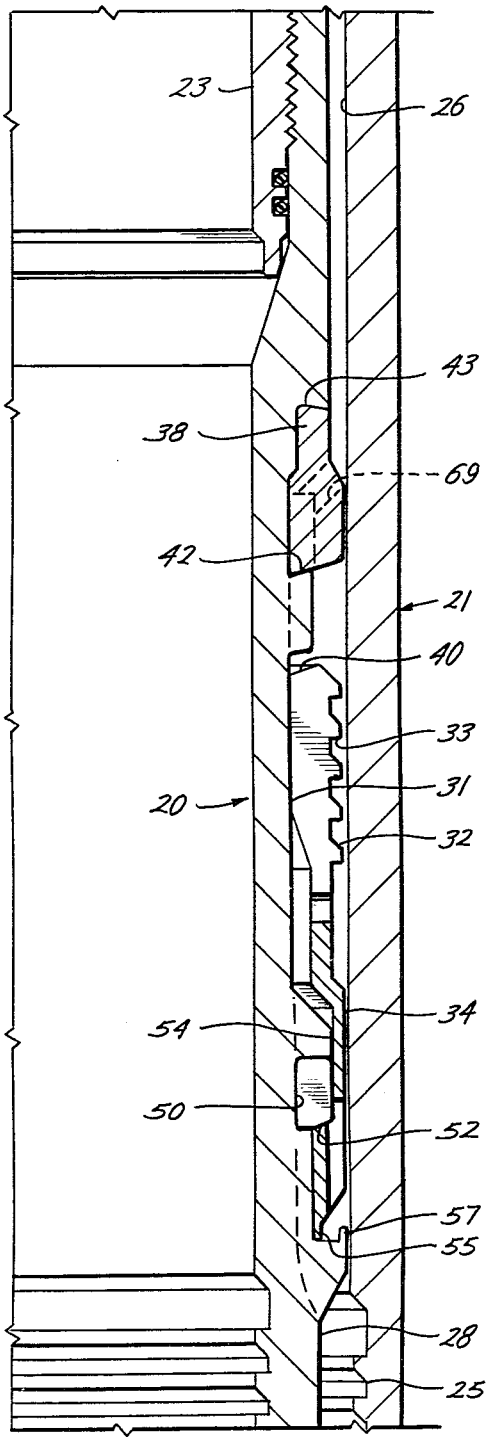
FIG. 4 is a vertical sectional view of the right-hand side of the apparatus of FIG. 1, during lowering of the inner hanger body into a position opposite seating surfaces on the bore of the outer hanger body, and thus with the landing ring contracted to permit it to be moved through the upper end of the bore in the outer hanger body above such surfaces.
Figure 5:
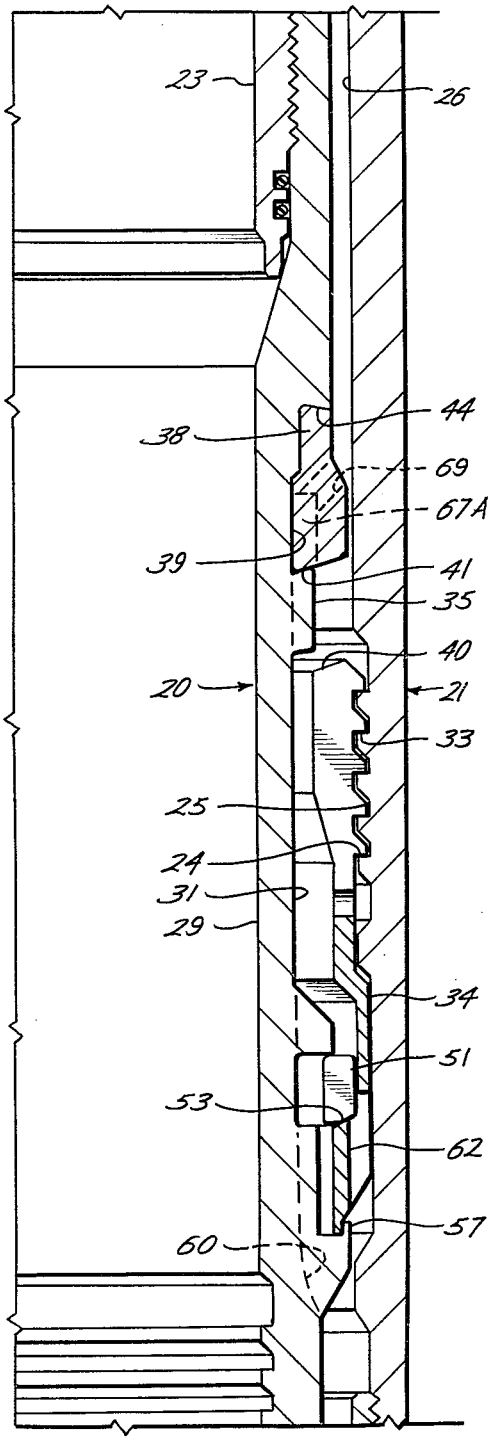
Figure 6:
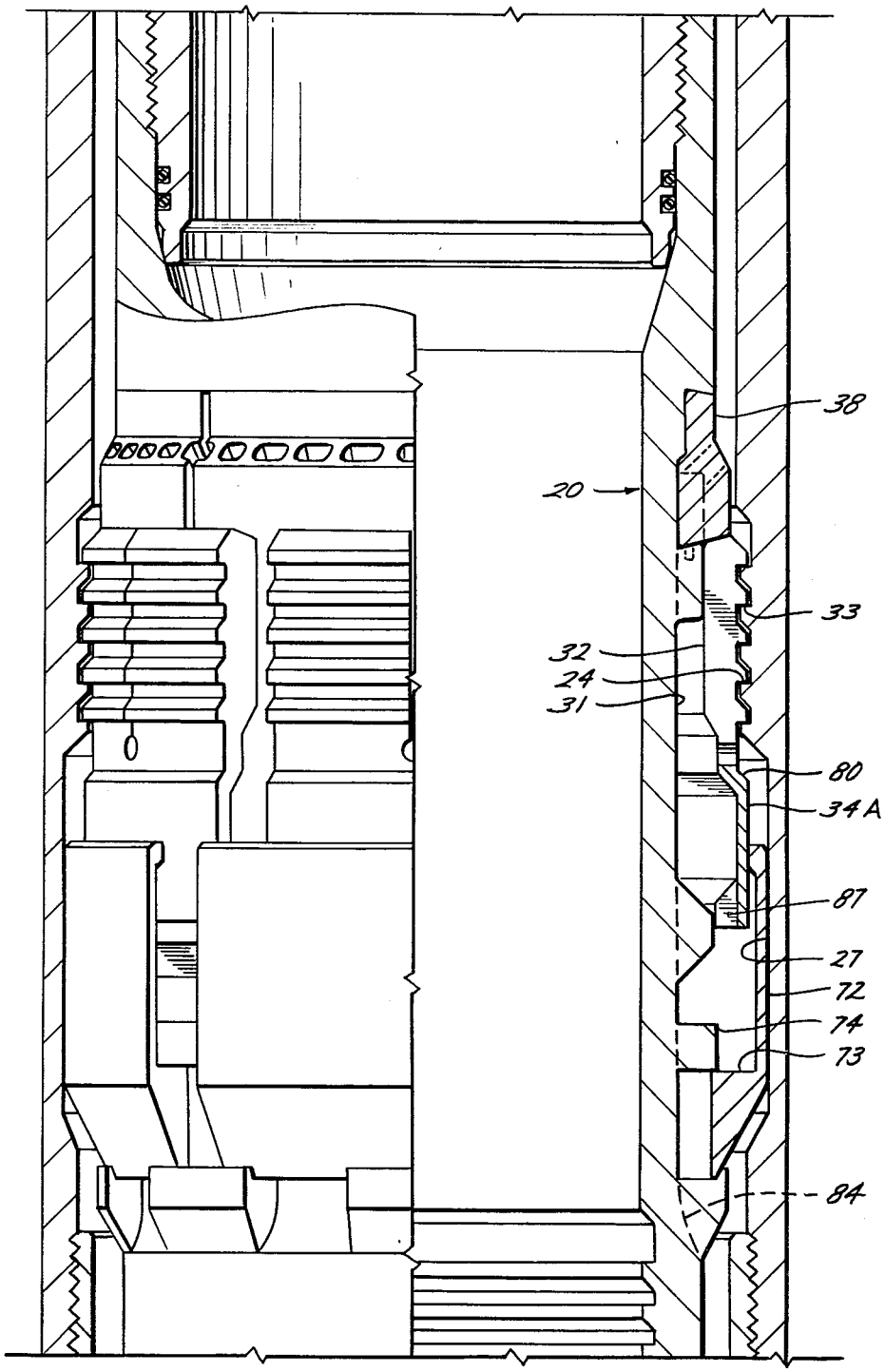
Figure 7:
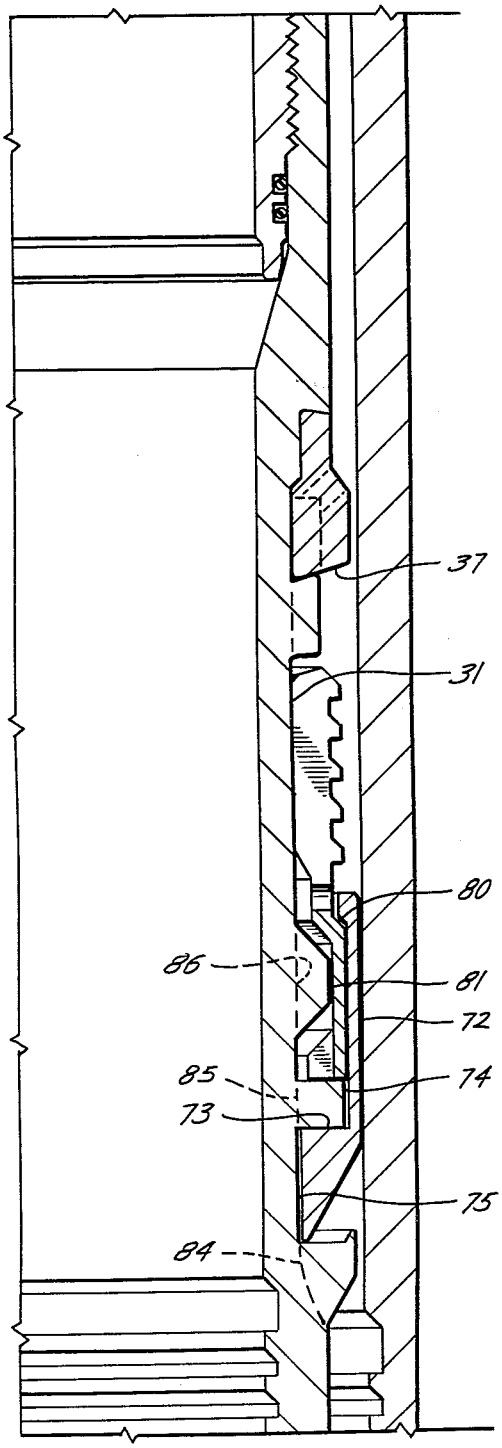
Figure 8:
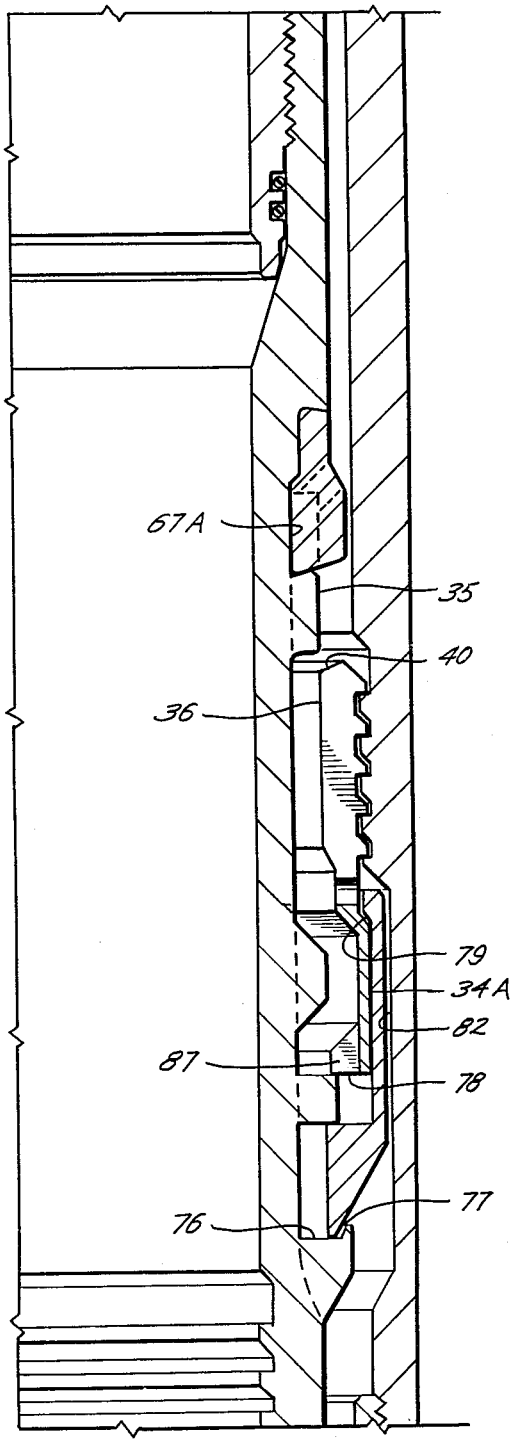

FIG. 5 is a view similar to FIG. 4, but upon further lowering of the inner hanger body to dispose the landing ring opposite the seating surfaces in the bore of the outer hanger body and thus to permit it to move outwardly into landed position thereon, but prior to subsequently lowering the inner hanger body with respect to the landing ring so as to support the inner hanger body therefrom, as shown in FIG. 1;

FIG. 6 is a vertical sectional view, similar to FIG. 1, of the apparatus constructed in accordance with another embodiment of the invention; and FIGS. 7 and 8 are vertical sectional views of the right-hand side of the apparatus of FIG. 6, but showing the inner hanger body and landing ring thereof in the same relative positions with respect to the outer hanger body that are shown in FIGS. 4 and 5, respectively.

With reference now to the details of the above-described drawings, the wellhead apparatus constructed in accordance with the first-described embodiment of the invention is shown in FIG. 1 to comprise an inner hanger 20 landed within and upon an outer hanger 21 so as to suspend an inner casing (not shown) connected to its lower end within an outer casing 22 connected to the lower end of the outer hanger. As well known in the art, an upper continuation (not shown) of the outer casing extends to pressure control equipment mounted on a rig or platform at the water surface. The inner hanger and inner casing suspended therefrom have been lowered into supported position on the outer casing string by means of a running tool 23 connected to the upper end of the hanger.

During drilling of the portion of the bore hole at the ocean floor to receive the inner casing, drilling mud returns flow upwardly between the drill string and the outer casing and its upward continuation. Then, as a successively inner casing is lowered into the inner casing shown, the inner casing and its upper continuation serves as a means for returning drilling mud to the pressure control equipment. As also well known in the art, the lower ends of the casings are anchored within well bores by means of columns of cement which may extend upwardly into the annular space between adjacent casings. Thus, as will be described, the inner hanger has flow passages formed therein which connect the annular space between the inner and outer casings above and below the hanger so as to permit cement returns to pass upwardly therethrough.

A plurality of vertically spaced grooves 25 are formed within a recessed portion of the bore 26 of the tubular body of the outer hanger intermediate its upper and lower ends, the lower end of each groove thus forming an upwardly facing seating surface 24. Also, an annular recess 27 is formed in the bore of the outer hanger body beneath the seat surfaces thereon for a purpose to be described to follow.

Figure 2:
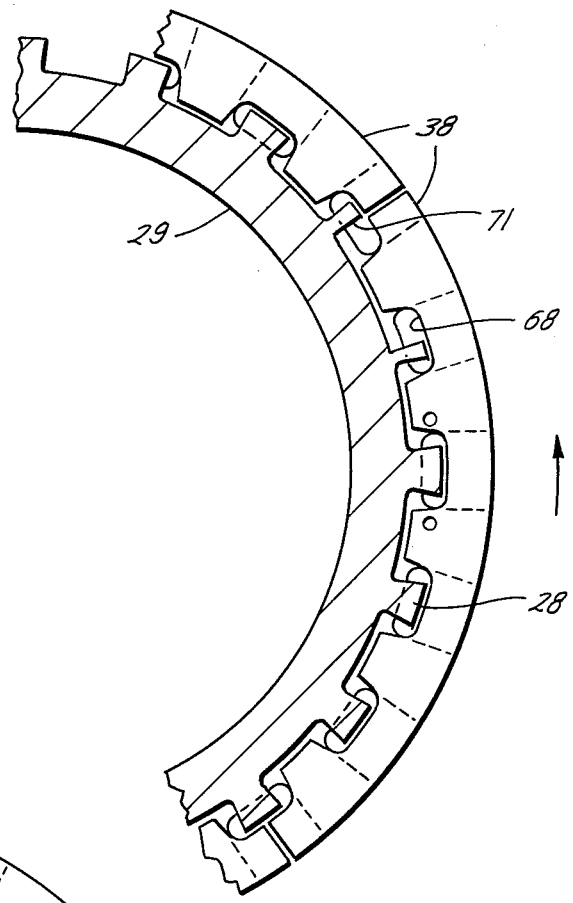
FIGS. 2 and 3 are cross sectional views of the inner hanger body, as seen along broken lines 3—3 of FIG. 1, FIG. 2 showing the load ring segments in positions they occupy during assembly or disassembly on the hanger body, and FIG. 3 showing them assembled in the load carrying position of FIG. 1.
Figure 3:
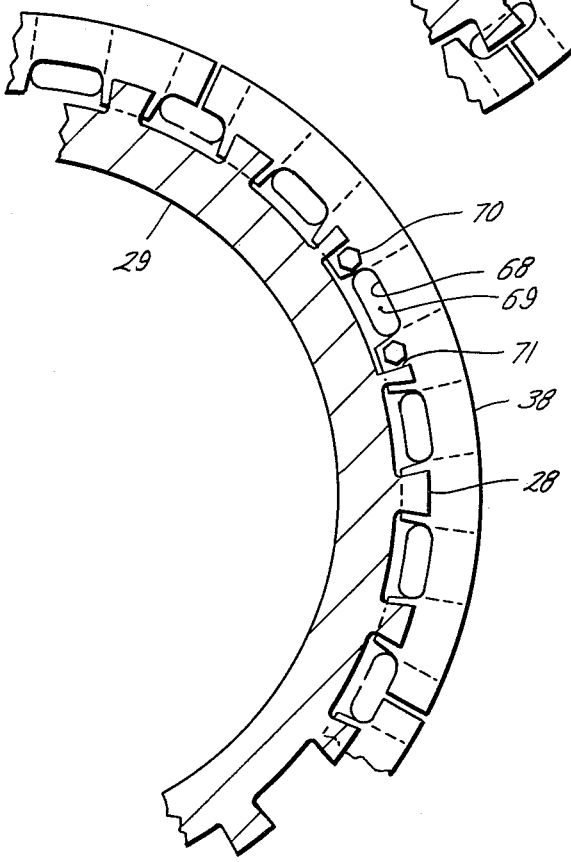

The inner hanger includes a tubular body 28 having a bore 29 therethrough and an outer diameter which fits relatively closely within the bore 26 of the outer hanger body. A recess 31 is formed about the inner hanger body intermediate its upper and lower ends, and a circumferentially split landing ring 32 is arranged about the body 28 for expansion and contraction within the recess 31 between the contracted position of FIG. 2, as the inner hanger is moved vertically within the bore of the outer hanger body, either to land the inner hanger body or retrieve it, and the expanded position of FIGS. 1 and 3 in which the inner hanger body is landed within the outer hanger body.

A plurality of vertically spaced teeth are formed about the upper end of the landing ring so as to provide a plurality of downwardly facing landing surfaces 33 which are spaced apart distances corresponding to the seating surfaces 24, and thus to move into landed positions thereon when disposed opposite thereto. More particularly, the grooves and teeth are of substantially the same depth so that the landing surfaces are free to expand outwardly into fully supported positions on the seating surfaces as the landing ring moves outwardly to expanded position. Although the outer hanger body and the landing ring are shown to have a plurality of seating and landing surfaces, respectively, it is contemplated, in accordance with the broader aspects of the present invention, that there may instead be only one set of such surfaces.

As shown, landing surfaces are also formed on the bore of the inner hanger body so that a successively inner hanger may be landed thereon in order to suspend a successively inner casing within the inner casing. If desired, a landing ring and other parts to be described may be arranged about the outer hanger body for landing upon a successively outer hanger and thus suspending the outer casing within a succesively outer casing.

As previously described, the landing ring is of such construction that it tends to assume its expanded position, and, as will be described to follow, is retained against upward movement with respect to the inner hanger body by releasable detent means, as the landing ring moves between expanded and contracted positions. The landing ring includes a skirt 34 depending from its upper end and having an outer diameter somewhat larger than that of the teeth about the upper end of the landing ring so as to slide downwardly over the bore of the outer hanger body, as well as within the upper casing extension, and thus protect the landing surfaces against accidental damage. The skirt is preferably of thin cross section and has a recess on its inner diameter, for a purpose to be described.

More particularly, the skirt is of considerably greater axial extent than the grooves on which the seating surfaces are formed in that they will move thereover while continuing to maintain the landing ring collapsed. However, the skirt is shorter than recess 27 in the bore of the hanger body and so spaced vertically beneath landing surfaces 33 as to expand outwardly into the recess when the landing surfaces are opposite the seating surfaces 24. As a result, the landing surfaces are free to expand into landed position on the seating surfaces.

When the landing ring is so landed, as shown in FIG. 5, and the weight of the inner casing has been slacked off to release the detent means and permit the inner hanger body to move downwardly with respect to the landing ring, a circumferential surface 35 about a radially enlarged portion of the inner hanger body above the recess 31 thereabout will move downwardly within an inner circumferential surface 36 on the upper end of the landing ring so as to hold the landing ring against contraction out of its landed position. More particularly, as the inner hanger body continues to move downwardly, a downwardly facing shoulder 37 on the radially outer portion of a load ring 38 carried within a groove 39 about the inner hanger body will land upon a shoulder 40 on the upper end of the landing ring so as to support the body from the landing ring. As shown, when the load ring is carried within the groove about the inner hanger body, a shoulder 41 on the lower end of its radially inner portion is supported on a shoulder 42 formed on the lower end of the groove, and a shoulder 43 on the upper end thereof faces a shoulder 44 on the upper end of the groove.

The outer side of the inner hanger body is also radially enlarged beneath the recess 31, and a groove 50 is formed in the radially enlarged portion to receive a circumferentially split detent ring 51 for expansion and contraction therein between the contracted position of FIGS. 1 and 4 and the expanded position of FIG. 5. While in contracted position, the upper and lower ends of the inner circumference of the detent ring remain within the groove 50 so that it is held against vertical movement with respect to the inner hanger body. When expanded, the detent ring is partially removed from the groove, but held against upward movement with respect to the inner hanger body inasmuch as the upper end of its inner circumference is within the upper end of the groove 50.

As previously described, the detent ring is of such construction that it tends it assume its expanded position, so that during expansion thereof, as it is lowered from the position of FIG. 4 to that of FIG. 5, the detent ring is urged outwardly into engagement with a recess 54 on the inner side of the skirt of the landing ring. When so disposed, a downwardly and inwardly tapered shoulder 52 on the lower end of the detent ring is engaged with an upwardly facing, tapered shoulder 53 on the lower end of the recess on the inner side of the landing ring skirt, so as to releasably retain the landing ring in a vertical position with respect to the inner hanger body in which it is free to expand and contract within the recess 31 about the inner hanger body.

As shown in FIG. 4, as the hanger is being lowered into the bore of the outer hanger, the landing ring is fully contracted so that the recess 54 on the inner side of its skirt compresses the detent ring 51 into its fully contracted position within groove 50. Then, however, when the landing ring has been lowered into a position opposite the seating surfaces on the outer hanger body, and has expanded outwardly into landing engagement therewith, the landing ring is expanded with it. Thus, the detent ring remains tightly engaged with the inner side of recess 54 and thus its shoulder 52 maintains engagement with shoulder 53.

As shown, the lowermost end of the skirt has a rim 55 which is received within an annular recess 56 formed on the lower end of the lower radially enlarged portion in which groove 50 is formed. A lip 57 about the outer circumference of the recess serves to limit outward expansion of the landing ring by engaging with the rim on the lower end of the skirt. Normally, of course, the rim does not engage this lip before the landing surfaces on the landing ring are moved into fully expanded positions upon the seating surfaces on the inner hanger body.

When the weight of the inner casing is slacked off the shoulder 52 on the lower end of the detent ring 52 will slide downwardly over the tapered shoulder 53 on the skirt so as to contract the detent ring until the outer circumference of the detent ring moves within the inner circumference of the skirt beneath the shoulder 53 so as to release the detent ring for sliding downwardly within the circumference of the lower end of the skirt. At this time, the inner circumference of the detent ring has moved within the lower side of groove 50, so that the detent ring will be carried downwardly with the inner hanger body until the seating surface 37 on the load ring 38 engages the upwardly facing shoulder 40 on the landing ring.

More particularly, the landing ring is more resistant to expansion, when in landed position, than is the detent ring to contraction. Hence, as above described, slacking off of the weight of the inner casing will cause the detent ring to contract in order to release the inner hanger body for movement downwardly with respect to the landing ring so as to move into its supported position on the landing ring.

As previously described, the inner hanger may by reset or returned to its FIG. 4 position in the event of inadvertent landing of the landing ring, merely upon lifting the inner hanger body from the position of FIG. 1 to the position of FIG. 5 so as to dispose the landing ring opposite the recess 31 about the inner hanger body, whereby it is free to expand and contract therein. Thus, the detent ring 51 has been raised with the hanger body, and along the inner circumference of the lower end of the skirt, until it reaches and moves upwardly and outwardly along the tapered seating surface 53 of the skirt into a position within recess 54 in which the shoulder on its lower end is reengaged with the shoulder 53, as shown in FIG. 5. This of course merely requires that the inner hanger body be lifted a few inches from the position of FIG. 1 to the position of FIG. 5.

In order to land the inner hanger at an upper level, it need only be lifted from the position of FIG. 5, which will cam the landing ring inwardly to the position of FIG. 4 as a downwardly and outwardly tapered shoulder on the upper end of the outer circumference of the landing ring engages a similarly shaped shoulder on the bore of the outer hanger body above the seating surfaces thereon. This camming of the landing ring from expanded to contracted position will in turn urge the inner side of the recess 54 of the depending skirt against the detent ring 51, so as to cause the detent ring to move into fully contracted position within groove 50, as shown in FIG. 4, and to remove the skirt from groove 27.

As previously described, the various parts of the inner hanger are provided with bypasses to permit cement returns to be circulated upwardly therepast through the annular space between the inner and outer outer casings. For this purpose, the lower radially enlarged portion of the inner hanger body is provided with slots 60 which connect its lower end with its upper end and thus with the recess 31 in which the landing ring is expandible and contractible. In order to provide a greater cross-sectional bypass area, the outer side of the lower end of the skirt of the landing ring is also provided with slots 62 which connect the lower end of the skirt with the lower end of the recess 54 within the skirt. As will be seen from FIG. 1, when the inner hanger is in landed position, preparatory to the passage of mud returns through the annular space, slots 62 are generally opposite the detent ring 51 and thus compensate for the bypass area otherwise filled by the detent ring in this position of same relative to the landing ring.

As shown in FIG. 1, the landing ring is circumferentially separated at 64 so as to permit it to expand and contract the required amount. Further radial flexibility is provided for the upper end of the landing ring on which the landing surfaces are formed by means of saw cuts 65 formed therein and leading to key holes 66 at their lower ends.

Of course, the saw teeth and the circumferential split 64 of the landing ring do not provide any substantial cross-sectional bypass area. Thus, when the inner hanger body is landed on the outer hanger body, as shown in FIG. 1, mud returns will instead bypass through slots 67 formed in the radially enlarged portion on the outer side of the hanger body and aligned with slots 68 in the radially inner portion of the lower end of load ring 38. The upper ends of the slots 68 are in turn connected with oval-shaped ports 69 formed in the load ring and connecting at their upper ends to the outer side of the load ring and thus the annular space between the inner and outer hanger bodies above the landing ring.

As previously described, because of this novel construction of the hanger body and the associated parts of the load ring, it is possible to provide the required fluid bypass while at the same time providing substantially full circle load surfaces between the shoulder 44 on the upper end of the groove 67A in the inner hanger body and the shoulder 43 on the upper end of the load ring 38, and between the shoulder 37 on the lower end of the radially outer portion of the load ring and the shoulder 40 on the upper end of the landing ring.

As shown, the upper end of the load ring and upper end of the groove in which the load ring is received taper downwardly and outwardly, while the lower end of the load ring and lower end of the landing ring taper upwardly and outwardly. This particular configuration of the loading surfaces not only facilitates firmly supporting the inner hanger body on the loading ring and the loading ring on the landing ring, but also serves as a convenient means for retaining the loading ring within the groove. For this purpose, the loading ring is made up of arcuate segments 38A which are adapted to be disposed within the groove in closely spaced-apart relation, as shown on the left-hand side of FIG. 1. Thus, the solid portions of the loading ring disposed between adjacent slots 68 formed therein are of lesser circumferential arcuate extent than are the slots 67, so that, during assembly, the segments may be indexed slightly to one side of the positions they are to occupy when assembled, to permit them to be moved over the intervening pieces of the radially enlarged portion intermediate the slots 68 therein. Then the load ring segments may be moved upwardly, to the position shown in FIG. 1, and then rotated slightly to one side in order to bring the solid portions separating the slots therein into vertical alignment with the solid portions of the radially enlarged portion of the inner hanger body which separate the slots 67 formed therein, thereby providing vertical support for the load ring segments as the slots 67 and 68 are brought into alignment. When so assembled, the load ring segments may be prevented from rotating out of position by means of pins 70 adapted to fit within holes on the lower sides of the solid portions of the inner diameter portion of the lower end of the load ring intermediate the slots 68. These pins are thus engageable with shoulders 71 formed on the opposite sides of the slots 67 in the radially enlarged portion of the inner hanger body.

The alternative embodiment of the wellhead apparatus illustrated in FIGS. 6 to 8 is identical to that above described in connection with FIGS. 1 to 5, with the exception of the construction and arrangement of the detent means. Hence, many of the parts and elements of the second embodiment will carry reference characters identical to those of corresponding parts of the first described embodiment.

The primary difference between the detent means of the second and first embodiments is that, in the latter, the circumferentially split detent ring is of such construction that it tends to contract and is arranged around, rather than within, the lower end of the landing ring in such a manner as to retain the ring against upward movement with respect to the inner hanger body as the landing ring expands and contracts within the recess 31 of the hanger body 29. For this purpose, the detent ring 72 shown in FIGS. 6 to 8 includes a lower flange having shoulder 73 which extends radially inwardly beneath a radially enlarged flange 74 on the outer diameter of the inner hanger body above a lower recess 75 in which the flange is received as the detent ring expands and contracts between the positions shown in FIGS. 6 to 8. As it expands and contracts, a flange on the lower end of the detent ring slides within an annular recess 76 of the inner hanger body, and is limited in its outward expansion by a lip 77 about the recess.

The detent ring includes a skirt portion which extends upwardly from its lower flange in surrounding relation to a relatively thin skirt 34A on the lower end of the landing ring beneath the landing surfaces 33 about its upper end. The lower end of the skirt portion of the landing ring also has an inwardly extending flange 78 which is slidable over the upper side of the flange 74 as the landing ring moves between expanded and contracted positions. The upper end of the skirt portion of the detent ring is turned inwardly to provide a downwardly facing shoulder 79 for releasably engaging an upwardly facing shoulder 80 on the outer side of the landing ring intermediate the landing surfaces thereon and the skirt portion thereof. More particularly, these surfaces are tapered downwardly and outwardly so as to facilitate their disengagement to enable the inner hanger body to be lowered into supported position on the landing ring, in a manner to be described.

As shown in FIG. 7, as the inner hanger is moved downwardly within the bore of the outer hanger, the detent ring and landing ring are contracted, to the extent permitted by engagement of the inner side of the skirt on the landing ring with a radially enlarged portion 81 of the outer side of the inner hanger body above the recess 76 and at the lower end of the recess 31. The outer surface of the skirt portion 72 of the detent ring is adapted to slide downwardly over the inner diameter of the upper casing extension of the outer casing as well as the bore of the outer casing body above the landing surfaces thereon, and thus protect the landing surfaces of the landing ring from accidental damage. The landing ring is sufficiently stronger than the detent ring so that even though the lower skirt portion of the landing ring is surrounded by the skirt portion of the detent ring, as the inner hanger moves downwardly into a position in which the landing surfaces of the landing ring are opposite the seating surfaces on the outer hanger body, the landing ring will expand outwardly into fully landed engagement with the landing surfaces. At this time of course, the skirt portion of the detent ring has expanded into ecess 82 in the outer hanger body.

As the landing ring expands outwardly into the fully landed position of FIG. 8, the shoulder 73 on the lower flange of the detent ring remains in engagement with the flange 74, so that detent shoulder 79 continues to retain the landing ring against upward movement with respect to the inner landing body as the landing ring expands and contracts within recess 31. As will be noted from FIG. 8, the lower end of the detent ring is spaced from the retainer lip 77 on the inner hanger body an amount greater than the radial extent of the engagement of the detent shoulders 79 and 80 as well as the radial space between the outer diameter of the detent ring and the recess 82 in the outer hanger body which receives the expanded detent ring.

Hence, as the weight of the inner casing is slacked off, the inner hanger body will, through the engagement of its flange 74 with the shoulder 73 on the detent ring, cause the shoulder 79 on the detent ring to slide downwardly over the shoulder 80 on the landing ring so as to release the inner hanger body for downward movement with respect to the landing ring. Thus, the inner diameter of the inturned portion on the upper end of the skirt of the detent ring will slide downwardly over the outer diameter of the lower skirt portion of the landing ring, at least until the inner circumferential surface 36 on the upper end of the landing ring moves within the outer circumferential surface 35 on the radially enlarged portion of the inner hanger body above the recess 37 therein, and the support surface shoulder 37 on the load ring 33 moves into seated engagement with the shoulder 40 on the upper end of the landing ring. Thus, due to the relative strength of the landing rings and detent rings, the disengagement of the detent shoulders does not require contraction of the landing ring out of its fully expanded position so that its outer circumferential surface is free to move upwardly within the inner circumferential surface of the inner hanger body, as above described.

Although not identical, the bypasses formed in the inner hanger are much the same as those formed in the inner hanger of the first embodiment. Hence, slots 84 are formed in the lowermost radially enlarged portion to connect the lower end thereof with the recess 75. Additionally, substantially vertically aligned slots 85 are formed in the flange 74, and further substantially vertically aligned slots 86 are formed in the radially enlarged portion 81 of the inner hanger body at the lower end of the recess 31. Still further, slots 87 are formed in the flange of the skirt portion of the landing ring to connect its lower end with the recess formed therein. Thus, with the inner hanger in its fully supported position of FIG. 6, mud returns may flow freely through both the slots 84, 85 and 86 in the inner hanger body and the slots 87 in the landing ring. From this point, the returns flow upwardly into slots in the upper radially enlarged portion of the inner hanger body and the inner radial portion of the load ring 38, and thence through the ports in the load ring, as previously described. In this respect, the construction of the load ring, and its cooperation with the inner hanger body as well as the landing ring is identical to that described in connection with the first embodiment.

Of course, in order to reset the landing ring, the inner hanger body need only be raised a few inches above its FIG. 6 position to raise detent shoulder 79 above detent shoulder 80.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Apparatus for use in suspending an inner casing within an outer casing of an offshore well at the ocean floor, comprising an outer hanger body having a bore therethrough and adapted to be connected to the outer casing for lowering therewith into a landed position at the ocean floor, said bore having at least one upwardly facing seating surface thereabout, an inner hanger body including a tubular body adapted to be connected to the inner casing for lowering therewith into the outer hanger body, and having a recess thereabout, a circumferentially split landing ring having at least one downwardly facing landing surface thereabout and arranged about the inner hanger body for expansion and contraction within the recess between a position in which it is free to pass into the bore of the outer hanger body for disposal opposite the seating surface and an expanded position in which the landing surface thereabout is landed on said seating surface, said landing ring being of such construction that it will tend to assume its expanded position, means for retaining the landing ring against upward movement with respect to the inner hanger body as the landing ring expands and contracts within said recess, said retaining means being releasable, when the landing ring is landed on the outer hanger body and the weight of the inner casing is slacked off, to permit the inner hanger body to be lowered with respect thereto, said inner hanger body having a radially enlarged, portion at the upper end of the recess whose outer circumferential surface is adapted to move within an inner circumferential surface of the landing ring in order to hold the landing ring in landed positions, as the inner hanger body is so lowered, and a groove thereabout above the radially enlarged portion, and a load ring carried within the groove with the radially inner portion of its lower end supported on the lower end of the groove, and a substantially circumferentially continuous shoulder on its upper end facing a substantially circumferentially continuous shoulder on the upper end of the groove for abutment therewith, the radially outer portion of the lower end of the load ring having a substantially circumferentially continuous shoulder adapted to be supported on a substantially circumferentially continuous shoulder on the landing ring when the landing ring is in landed position and the inner hanger body has been so lowered to dispose its circumferential surface within the inner circumferential surface of said landing ring, the radially enlarged portion of the inner hanger body and the radially inner portion of the load ring having connecting slots therein, and said load ring also having ports therein connecting the upper ends of the slots therein with the outer side of the load ring, whereby well fluid may circulate through the annular space between the inner hanger body and bore of the outer hanger body.

2. Apparatus of the character defined in claim 1, wherein the substantially circumferentially continuous shoulders of the load ring are of substantially the same area.

3. Apparatus of the character defined in claim 1, wherein the shoulder on the lower end of the load ring and the shoulder of the landing ring on which the load ring is to be supported are tapered so as to urge the landing ring outwardly to landed position as the inner hanger body is lowered with respect thereto.

4. Apparatus of the character defined in claim 1, wherein the load ring comprises arcuate segments having their opposite ends close to one another.

5. Apparatus for use in suspending an inner casing within an outer casing of an offshore well at the ocean floor, wherein an outer hanger body having a bore therethrough and at least one upwardly facing seating surface thereabout is connected to the outer casing for lowering therewith into a landed position at the ocean floor; said apparatus comprising an inner hanger body including a tubular body adapted to be connected to the inner casing for lowering therewith into the outer hanger body, and having a recess thereabout, a circumferentially split landing ring having at least one downwardly facing landing surface thereabout for expansion and contraction within the recess between a position in which it is free to pass into the bore of the outer hanger body for disposal opposite the seating surface and an expanded position in which the landing surface thereabout is landed on said seating surface, said landing ring being of such construction that it will tend to assume its expanded position, means for retaining the landing ring against upward movement with respect to the inner hanger body as the landing ring expands and contracts within said recess, said retaining means being releasable, when the landing ring is landed on the outer hanger body and the weight of the inner casing is slacked off, to permit the inner hanger body to be lowered with respect thereto, said inner hanger body having a radially enlarged portion at the upper end of the recess whose outer circumferential surface is adapted to move within an inner circumferential surface of the landing ring in order to hold the landing ring in landed positions as the inner hanger body is so lowered, and a groove thereabout above the radially enlarged portion, and a load ring carried within the groove with the radially inner portion of its lower end supported on the lower end of the groove and a substantially circumferentially continuous shoulder on its upper end facing a substantially circumferentially continuous shoulder on the upper end of the groove for abutment therewith, the radially outer portion of the lower end of the load ring having a substantially circumferentially continuous shoulder adapted to be supported on a substantially circumferentially continuous shoulder on the landing ring when the landing ring is in landed position and the inner hanger body has been so lowered to dispose its circumferential surface within the inner circumferential surface of said landing ring, the radially enlarged portion of the inner hanger body and the radially inner portion of the load ring having connecting slots therein, and said load ring also having ports therein connecting the upper ends of the slots therein with the outer side of the load ring, whereby well fluid may circulate through the annular space between the inner hanger body and bore of the outer hanger body.

6. Apparatus of the character defined in claim 5, wherein the substantially circumferentially continuous shoulders of the load ring are of substantially the same area.

7. Apparatus of the character defined in claim 5, wherein the shoulder on the lower end of the load ring and the shoulder of the landing ring on which the load ring is to be supported are tapered so as to urge the landing ring outwardly to landed position as the inner hanger body is lowered with respect thereto.

8. Apparatus of the character defined in claim 5, wherein the load ring comprises arcuate segments having their opposite ends close to one another.

* * * * *